US009039429B2

(12) United States Patent
Shimoji

(10) Patent No.: US 9,039,429 B2
(45) Date of Patent: May 26, 2015

(54) WIRE-TO-BOARD CONNECTOR

(75) Inventor: Kenichi Shimoji, Tokyo (JP)

(73) Assignee: Japan Aviation Electronics Industry, Ltd., Tokyo (JP)

( * ) Notice: Subject to any disclaimer, the term of this patent is extended or adjusted under 35 U.S.C. 154(b) by 0 days.

(21) Appl. No.: 13/981,272

(22) PCT Filed: Aug. 10, 2011

(86) PCT No.: PCT/JP2011/004527

§ 371 (c)(1),
(2), (4) Date: Jul. 23, 2013

(87) PCT Pub. No.: WO2012/127541

PCT Pub. Date: Sep. 27, 2012

(65) Prior Publication Data

US 2013/0303037 A1 Nov. 14, 2013

(30) Foreign Application Priority Data

Mar. 23, 2011 (JP) ..... 2011-063640

(51) Int. Cl.
*H01R 12/57* (2011.01)
*H01R 12/75* (2011.01)
(Continued)

(52) U.S. Cl.
CPC ..... *H01R 12/75* (2013.01); *H01R 12/728* (2013.01); *H01R 12/7088* (2013.01); *H01R 13/20* (2013.01); *H01R 2101/00* (2013.01);
(Continued)

(58) Field of Classification Search
USPC ..... 439/852, 854, 81, 83, 825, 862, 848, 439/851, 293, 329, 63, 78, 354, 357, 358, 439/746, 748
See application file for complete search history.

(56) References Cited

U.S. PATENT DOCUMENTS 4,699,444 A * 10/1987 Isohata ..... 439/839
7,329,158 B1 * 2/2008 Roberts et al. ..... 439/851
(Continued)

FOREIGN PATENT DOCUMENTS

DE 19608470 A1 9/1997
EP 1885029 A1 2/2008
(Continued)

OTHER PUBLICATIONS

Extended European Search Report dated Jul. 3, 2014 from corresponding European Application No. 11861521.0; 9 pgs.
(Continued)

*Primary Examiner* — Abdullah Riyami
*Assistant Examiner* — Thang Nguyen
(74) *Attorney, Agent, or Firm* — Maier & Maier, PLLC

(57) ABSTRACT

A wire-to-board connector includes a plug attached to an electric wire and a receptacle mounted on a substrate. The plug and receptacle are formed by bending a metal plate. The electric wire is electrically connected to the substrate by fitting the plug with the receptacle. The receptacle includes an accommodating section formed in a tubular shape. The plug includes an insertion section to be inserted into the accommodating section. The insertion section has a claw and the accommodating section has an engaging surface. By inserting the insertion section into the accommodating section, the claw is engaged with the engaging surface and the plug is fitted with the receptacle. The claw and the engaging surface are configured so as to prevent a pull-out force acted on the electric wire from acting to disengage the engaged state between the claw and the engaging surface.

16 Claims, 19 Drawing Sheets

(51) Int. Cl.

| | |
|---|---|
| ***H01R 12/72*** | (2011.01) |
| ***H01R 13/20*** | (2006.01) |
| *H01R 12/70* | (2011.01) |
| *H01R 101/00* | (2006.01) |
| *H01R 13/11* | (2006.01) |
| *H01R 13/642* | (2006.01) |
| *H01R 13/05* | (2006.01) |

(52) U.S. Cl.
CPC ..... *H01R13/113* (2013.01); *H01R 13/642* (2013.01); *H01R 13/055* (2013.01)

(56) References Cited

U.S. PATENT DOCUMENTS

| | | | | |
|---|---|---|---|---|
| 7,497,715 | B2 * | 3/2009 | Wu | 439/329 |
| 2008/0305668 | A1 | 12/2008 | Wu | |

FOREIGN PATENT DOCUMENTS

| | | | |
|---|---|---|---|
| FR | 2786613 | A1 | 6/2000 |
| FR | 2850797 | A1 | 8/2004 |
| JP | 59-134289 | | 9/1984 |
| JP | H10-173311 | A1 | 6/1998 |
| JP | 2003-323930 | A | 11/2003 |
| JP | 2010-18663 | | 8/2010 |

OTHER PUBLICATIONS

International Search Report dated Sep. 13, 2011, as issued in corresponding International Patent Application No. PCT/JP2011/004527, filed Aug. 10, 2011 (with English translation).

Japanese Office Action as issued in Japanese Patent Application No. 2011-063640 (with English translation of relevancy).

* cited by examiner

WIRE-TO-BOARD CONNECTOR

RELATED APPLICATIONS

This is the U.S. national stage application which claims priority under 35 U.S.C. §371 to International Patent Application No.: PCT/W2011/004527 filed on Aug. 10, 2011, which claims priority to Japanese Patent Application No. 2011-063640 filed on Mar. 23, 2011, the disclosures of which are incorporated by reference herein their entireties.

TECHNICAL FIELD

The present invention relates to a wire-to-board connector.

BACKGROUND ART

As this type of technique, patent literature 1 discloses a structure for connecting a wire-side fast-on tab terminal 102, to which a wire 101 is attached, to a low-height type surface mounting fast-on tab terminal 100, which is surface-mounted on a substrate as shown in FIG. 19 of the present application.

CITATION LIST

Patent Literature

Patent literature 1: Japanese Unexamined Patent Application Publication. No. 2010-186663

SUMMARY OF INVENTION

Technical Problem

However, in the structure disclosed in patent literature 1, when a pull-out force, i.e., a force that is acted so as to pull out the wire 101 from the low-height type surface mounting fast-on tab terminal 100 is acted on the wire 101, the wire-side fast-on tab terminal 102 is sometimes pulled out from the low-height type surface mounting fast-on tab terminal 100.

An object of the present invention is to provide a wire-to-board connector capable of maintaining the fitted state of the connector even when a pull-out force is acted on the electric wire.

Solution to Problem

According to an aspect of the present invention, a wire-to-board connector, which includes: a first terminal attached to an electric wire; and a second terminal mounted on a substrate, and in which the first and second terminals are entirely formed of metal, and the electric wire is electrically connected to the substrate by fitting the first terminal with the second terminal, has the following structure. That is, the second terminal includes an accommodating section formed into a tubular shape. The first terminal includes an insertion section to be inserted into the accommodating section. One of the accommodating section and the insertion section is provided with a claw section and the other of the accommodating section and the insertion section is provided with an engaging section with which the claw section engages. By inserting the insertion section into the accommodating section, the claw section is engaged with the engaging section and the first terminal is thereby fitted with the second terminal. The claw section and the engaging section are configured so as to prevent a pull-out force acted on the electric wire from acting to disengage the engaged state between the claw section and the engaging section.

Further, the claw section is preferably formed in the insertion section. The engaging section is formed in the accommodating section.

Further, the insertion section preferably includes a pair of mutually-opposed side plates and a cantilever-shaped lock spring strip formed in a place closer to one of the pair of side plates than to the other side plate. The claw section is formed in the lock spring strip.

Further, a lock hole is preferably formed in a peripheral wall of the accommodating section, and a blocking plate is preferably formed in an opened end of the accommodating section that is opposite to an opened end into which the insertion section is inserted. The engaging section is formed on an inner peripheral surface of the lock hole.

Further, an improper insertion prevention protrusion that, when the posture of the insertion section is not appropriate as the insertion section is inserted into the accommodating section, physically interferes the insertion section and thereby prevents the insertion section from being inserted into the accommodating section is preferably formed in the accommodating section.

Further, the improper insertion prevention protrusion is preferably formed by lancing when the lock hole is formed.

Further, the accommodating section preferably includes a cantilever-shaped contact spring strip.

Further, in a joint of the accommodating section, which is formed into the tubular shape by bending a metal plate, a shape retaining mechanism for retaining the tubular shape of the accommodating section is preferably formed.

Further, the shape retaining mechanism is preferably implemented by a shape retaining protrusion and a shape retaining protrusion accommodating hole in which the shape retaining protrusion is accommodated.

Further, the accommodating section is preferably formed into a rectangular-tube shape.

Further, the second terminal preferably includes a pair of mutually-opposed side plates, and a guide strip that is formed in one of the pair of side plates and guides insertion of the insertion section into the accommodating section.

Advantageous Effects of Invention

According to the present invention, it is possible to maintain the fitted state of the wire-to-board connector even when a pull-out force is acted on the electric wire.

DESCRIPTION OF EMBODIMENTS

First Exemplary Embodiment

A first exemplary embodiment according to the present invention is explained hereinafter with reference to FIGS. 1 to 16.

Figure 1:
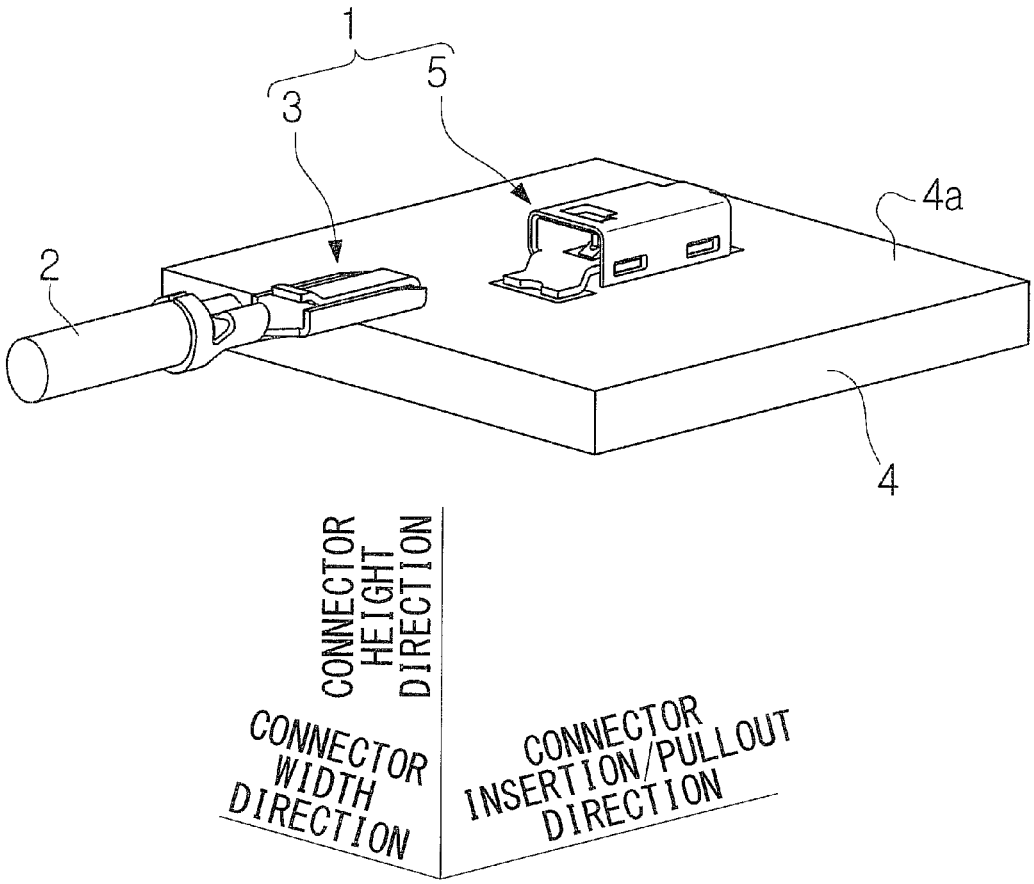
FIG. 1 is a perspective view of a wire-to-board connector before being fitted (first exemplary embodiment)
Figure 2:
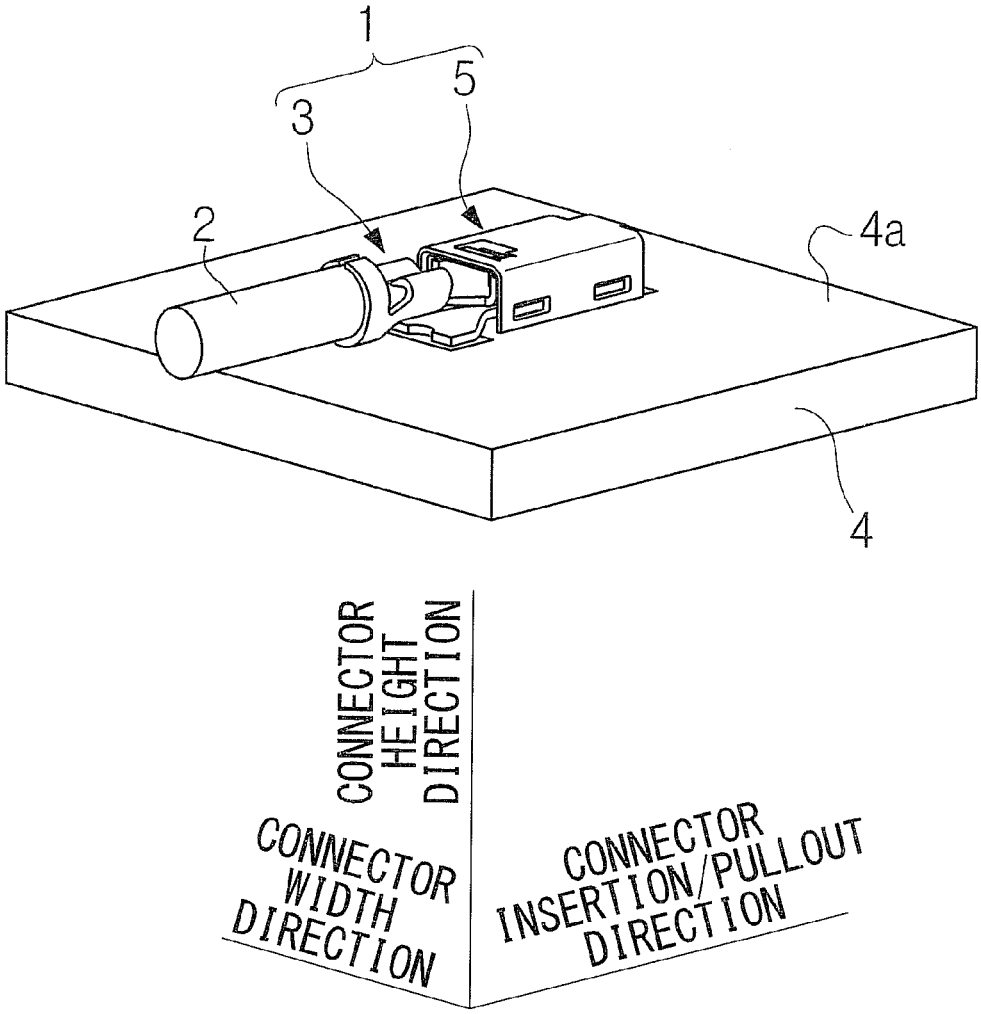
FIG. 2 is a perspective view of a wire-to-board connector in a fitted state (first exemplary embodiment)

As shown in FIG. 1, a wire-to-board connector 1 includes a plug 3 (first terminal) attached to an electric wire 2 and a receptacle 5 (second terminal) mounted on the surface of a substrate 4. In this exemplary embodiment, each of the plug 3 and the receptacle 5 is entirely made of metal and is integrally formed by bending a metal plate. Further, as shown in FIG. 2, the electric wire 2 is electrically connected to the substrate 4 by fitting the plug 3 with the receptacle 5.

Here, "connector insertion/pullout direction", "connector height direction", and "connector width direction" are defined. As shown in FIGS. 1 and 2, the "connector insertion/pullout direction" is a direction in which the plug 3 is pulled out from or inserted into the receptacle 5. The "connector insertion/pullout direction" includes "insertion direction" and "pull-out direction". The "insertion direction" is a direction in which the plug 3 is inserted into the receptacle 5. The "pull-out direction" is a direction in which the plug 3 is pulled out from the receptacle 5. The "connector height direction" is a direction perpendicular to the connector mounting surface 4*a* of the substrate 4. The "connector height direction" includes "mounting surface approaching direction" and "mounting surface receding direction". The "mounting surface approaching direction" is a direction approaching to the connector mounting surface 4*a* of the substrate 4. The "mounting surface receding direction" is a direction receding from the connector mounting surface 4*a* of the substrate 4. The "connector width direction" is a direction perpendicular to both the "connector insertion/pullout direction" and the "connector height direction".

(Receptacle 5: FIGS. 3 to 8)

As shown in FIGS. 3 to 8, the receptacle 5 includes an accommodating section 6 and a mounting section 7.

(Receptacle 5: Accommodating Section 6)

The accommodating section 6 is formed into roughly a rectangular-tube shape. That is, the accommodating section 6 includes a bottom plate 8, a pair of side plates 9, and a top plate 10. In other words, the peripheral wall of the accommodating section 6 is composed of a bottom plate 8, a pair of side plates 9, and a top plate 10. The pair of side plates 9 are opposed to each other.

Figure 3:
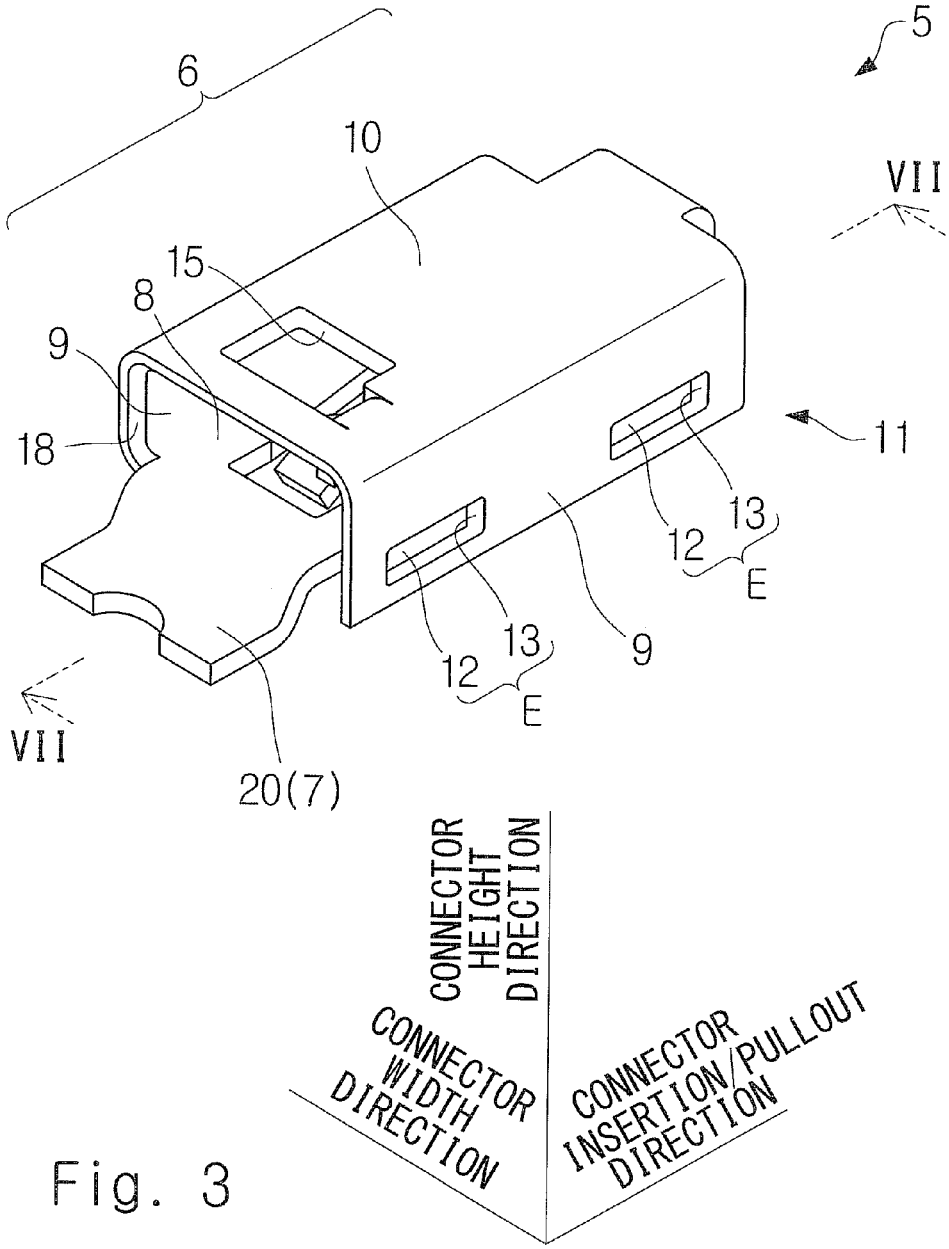
FIG. 3 is a first perspective view of a receptacle (first exemplary embodiment)

As shown in FIG. 3, a shape retaining mechanism E is formed in a joint 11 between the bottom plate 8 and one of the side plates 9. The shape retaining mechanism E is a mechanism for retaining the shape of the accommodating section 6, which has roughly a rectangular-tube shape. In this exemplary embodiment, the shape retaining mechanism E is implemented by a shape retaining protrusion 12 formed on the bottom plate 8, and a shape retaining protrusion accommodating hole 13 formed in the side plate 9. Further, the roughly rectangular-tube shape of the accommodating section 6 is retained by accommodating the shape retaining protrusion 12 in the shape retaining protrusion accommodating hole 13.

Figure 4:
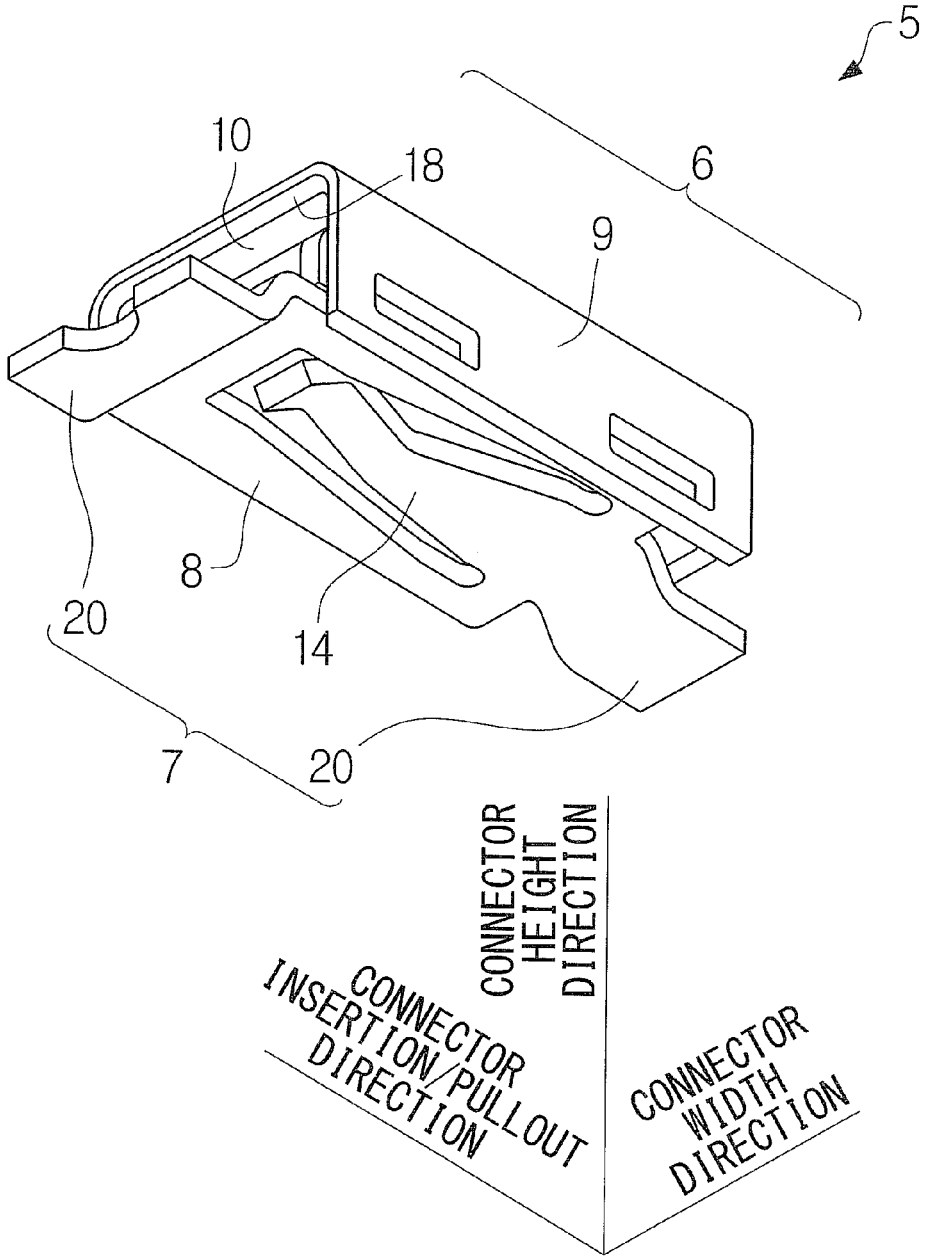
FIG. 4 is a second perspective view of a receptacle (first exemplary embodiment)
Figure 6:
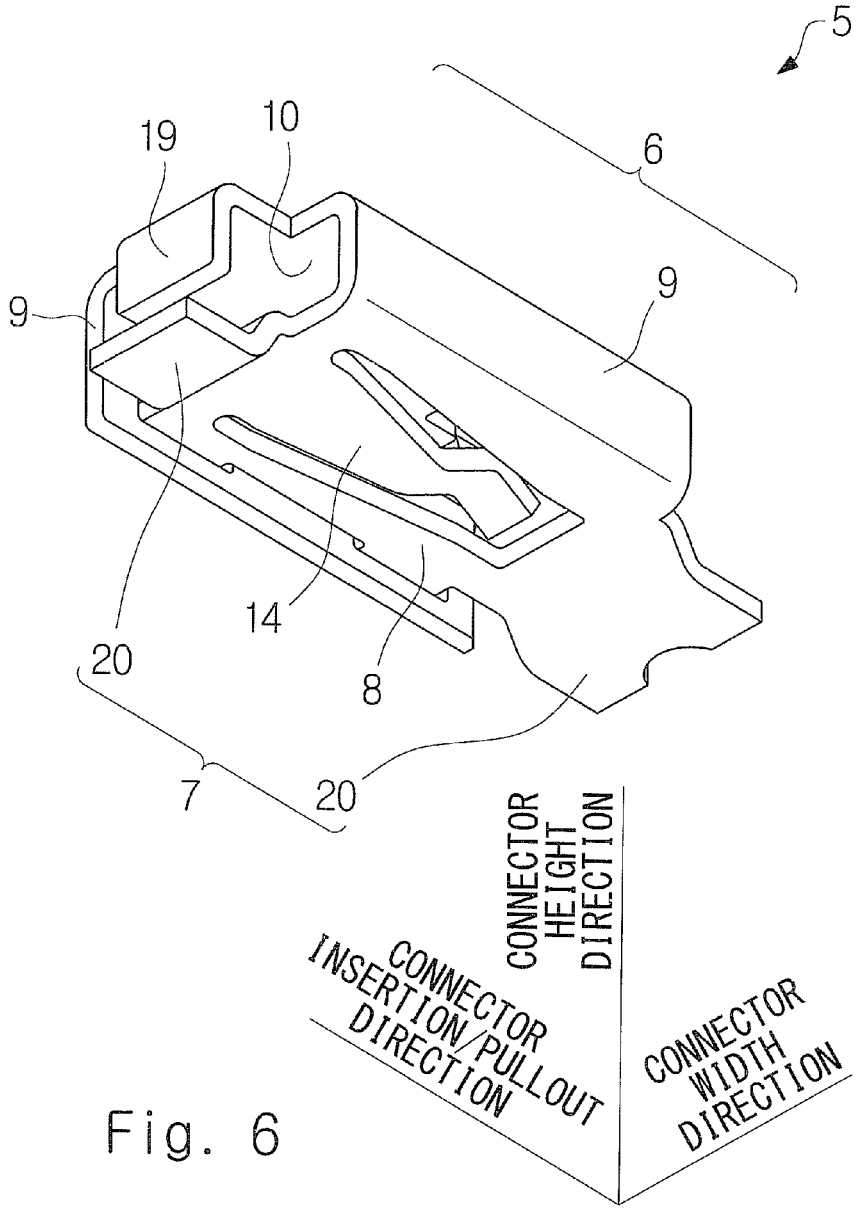
FIG. 6 is a fourth perspective view of a receptacle (first exemplary embodiment)
Figure 7:
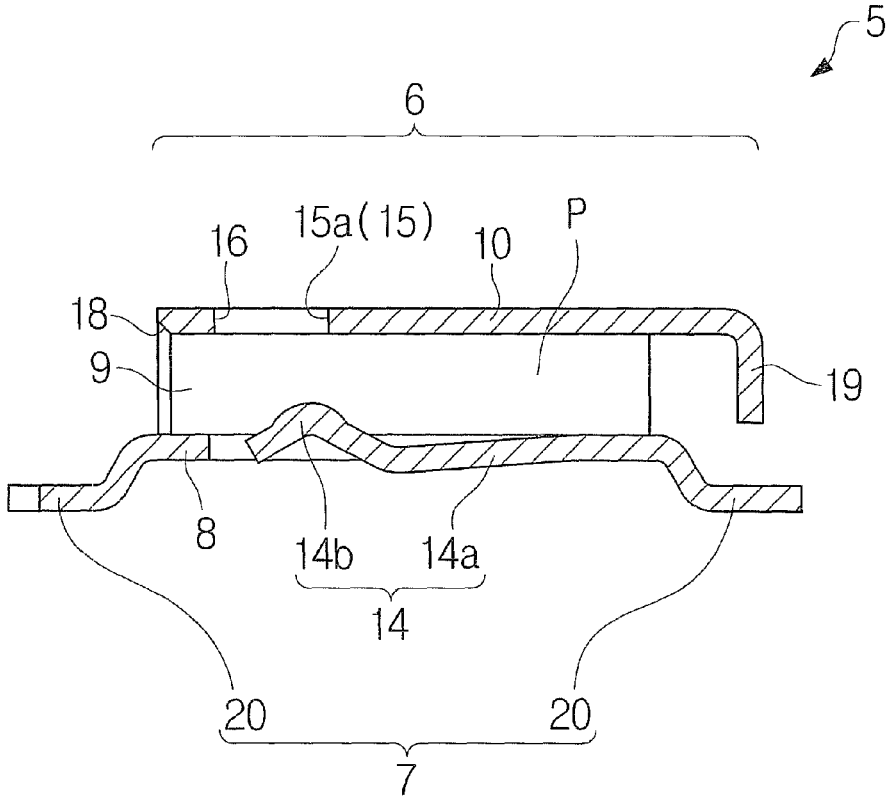
FIG. 7 is a cross section taken along a line VII-VII of FIG. 3 (first exemplary embodiment)
Figure 7:
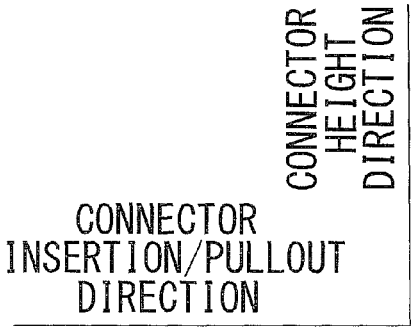

As shown in FIGS. 4, 6 and 7, a cantilever-shaped contact spring strip 14 is formed in the bottom plate 8. As shown in FIGS. 4 and 6, the contact spring strip 14 is formed by lancing a central part of the bottom plate 8. As shown in FIG. 7, the contact spring strip 14 is composed of a support spring strip 14*a* that is supported in a cantilever shape by the bottom plate 8, and a contact section 14*b* formed at the free end of the support spring strip 14*a*. The contact section 14*b* protrudes into internal space P of the accommodating section 6 in a state where no load is applied on the contact spring strip 14 shown in FIG. 7.

Figure 5:
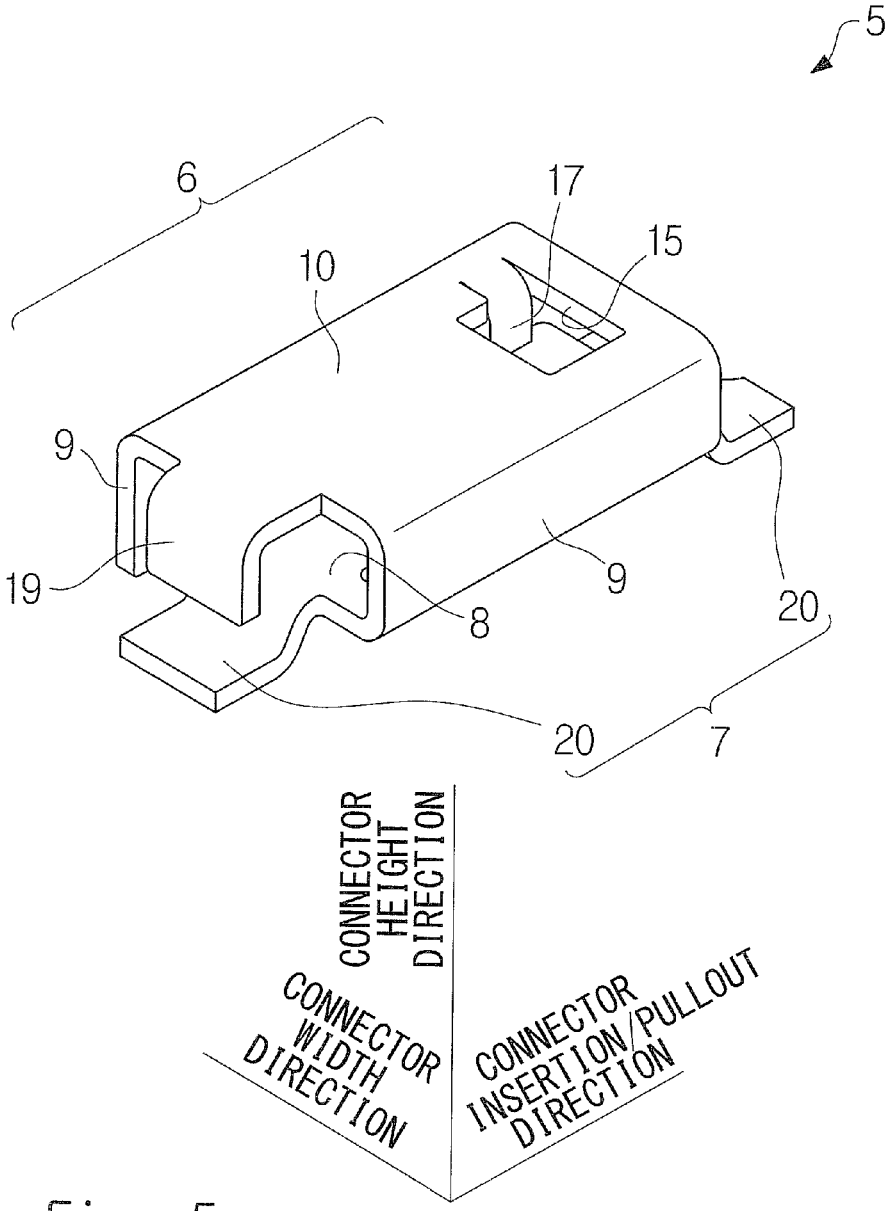
FIG. 5 is a third perspective view of a receptacle (first exemplary embodiment)
Figure 8:
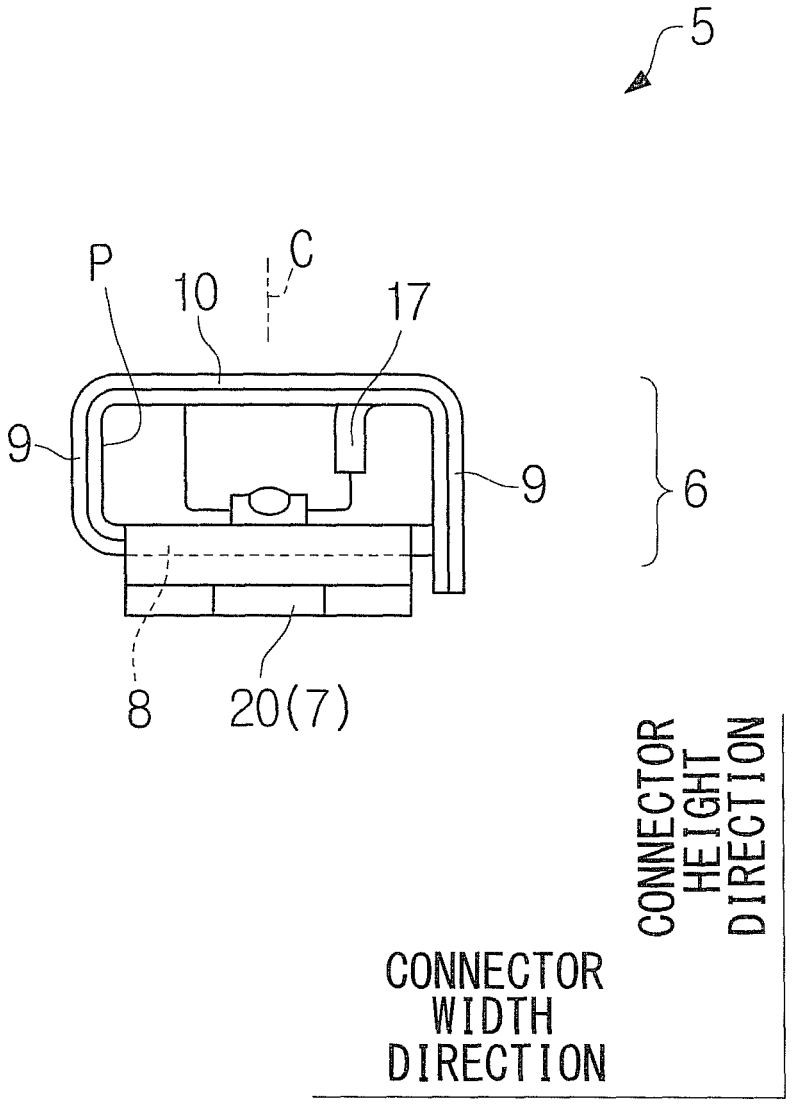
FIG. 8 is a front view of a receptacle (first exemplary embodiment)

As shown in FIGS. 3, 5 and 7, a lock hole 15 having roughly a rectangular shape is formed in the top plate 10. As shown in FIG. 7, the lock hole 15 is formed at such a position in the connector height direction that the lock hole 15 is roughly opposed to the contact section 14*b* of the contact spring strip 14. An engaging surface 16 (engaging section), which serves as a surface facing in the connector insertion direction, is formed on the inner peripheral surface 15*a* of the lock hole 15. Further, as shown in FIGS. 5 and 8, a key 17 (improper insertion prevention protrusion) is formed in the top plate 10. The key 17 connects to the top plate 10. Further, as shown in FIG. 8, the key 17 protrudes into the internal space P from the top plate 10 toward the bottom plate 8 along the connector height direction (in mounting surface approaching direction). As shown in FIG. 5, the key 17 is formed by lancing when the lock hole 15 is formed. As shown in FIG. 8, the key 17 is formed in a position that is deviated in the connector width direction from the center line C in the connector width direction of the accommodating section 6.

As shown in FIGS. 3, 4 and 7, a guide chamfering 18 is formed at an opened end of the accommodating section 6 into which an insertion section 31 is inserted. As shown in FIGS. 5 to 7, a blocking plate 19 is formed at an opened end of the accommodating section 6 that is opposite to the opened end into which the insertion section 31 is inserted. The opened end of the accommodating section 6 that is opposite to the opened end into which the insertion section 31 is inserted is blocked by the blocking plate 19. As shown in FIGS. 5 to 7, the blocking plate 19 is perpendicular to the connector insertion/pullout direction and connects to the top plate 10.

(Receptacle 5: Mounting Section 7)

As shown in FIGS. 4 to 7, the mounting section 7 is composed of a pair of soldering legs 20. Each of the soldering legs 20 connects to the bottom plate 8. Further, the soldering legs 20 are arranged so that the bottom plate 8 is interposed therebetween in the connector insertion/pullout direction.

Figure 9:
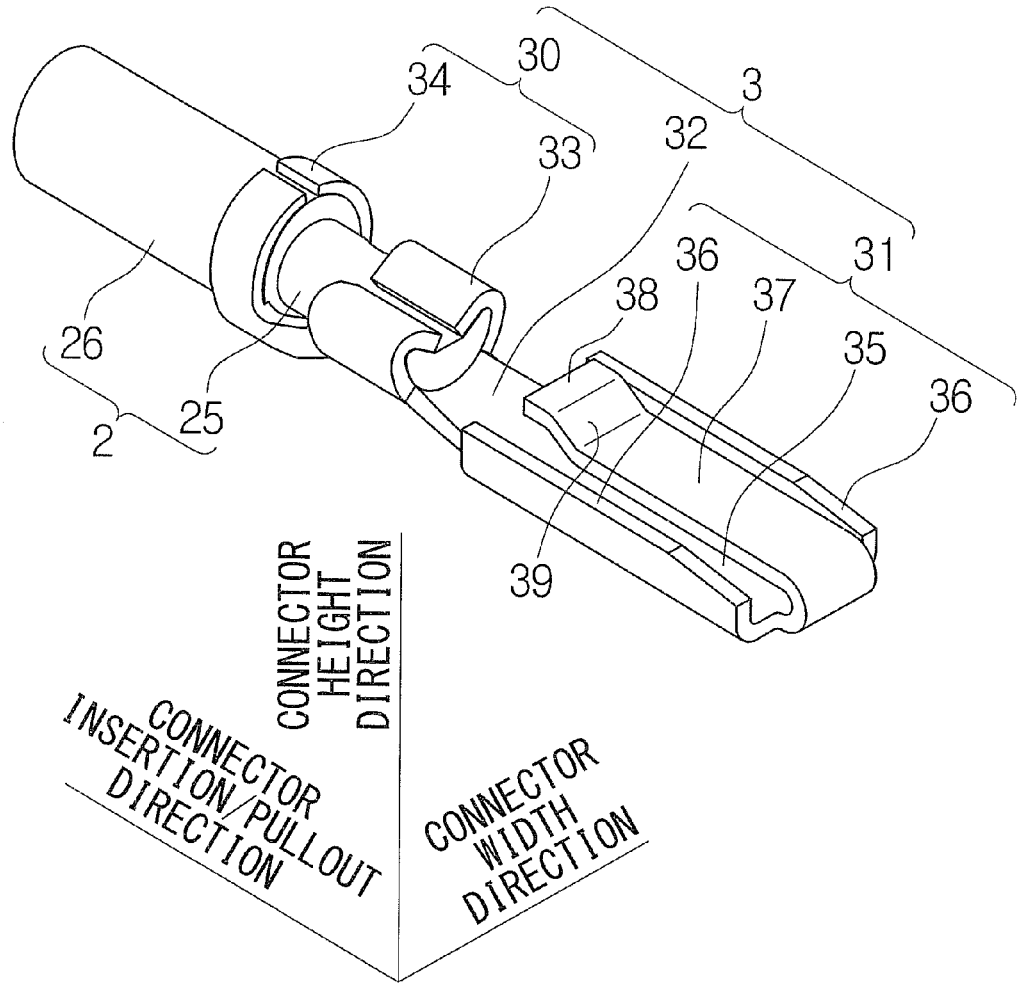
FIG. 9 is a perspective view of a plug (first exemplary embodiment)
Figure 10:
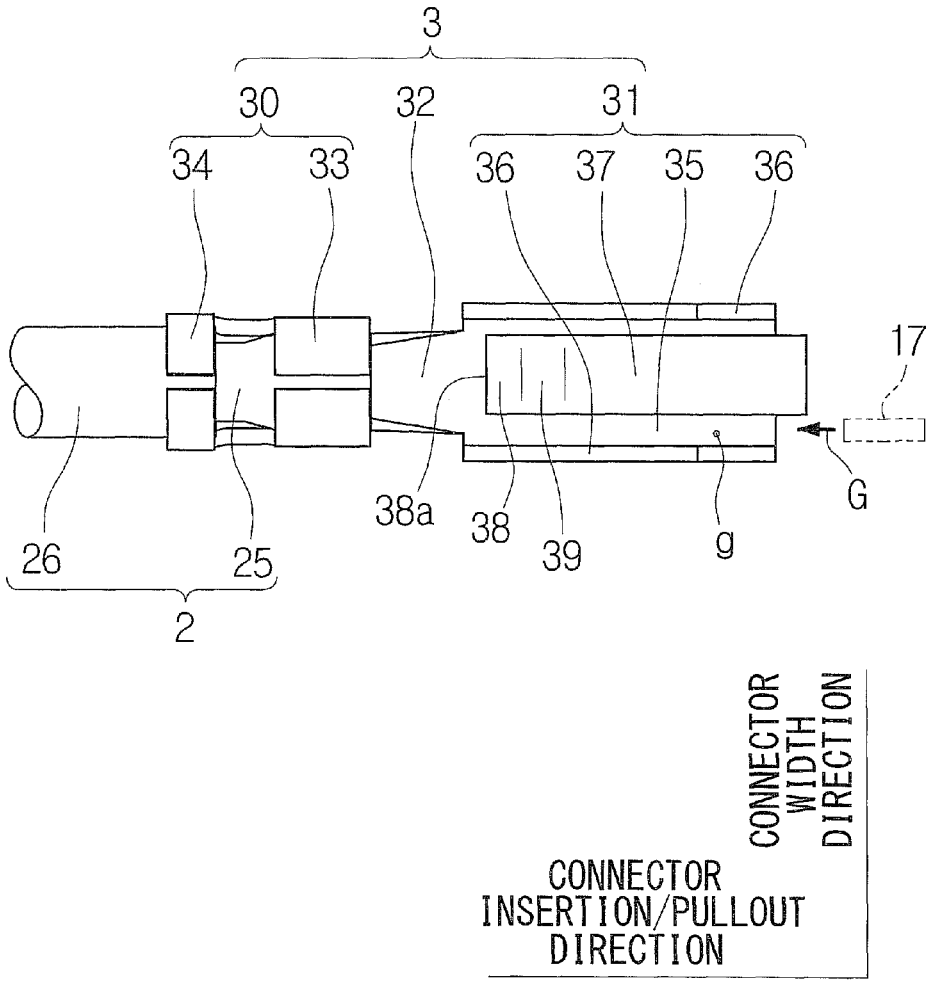
FIG. 10 is a plane view of a plug (first exemplary embodiment)

(Electric Wire 2: FIGS. 9 and 10)

In this exemplary embodiment, the electric wire 2 is composed of a stranded wire 25 and an insulating covering 26. The stranded wire 25 is covered by the insulating covering 26. As shown in FIG. 9, the stranded wire 25 is exposed in a predetermined length.

Figure 11:
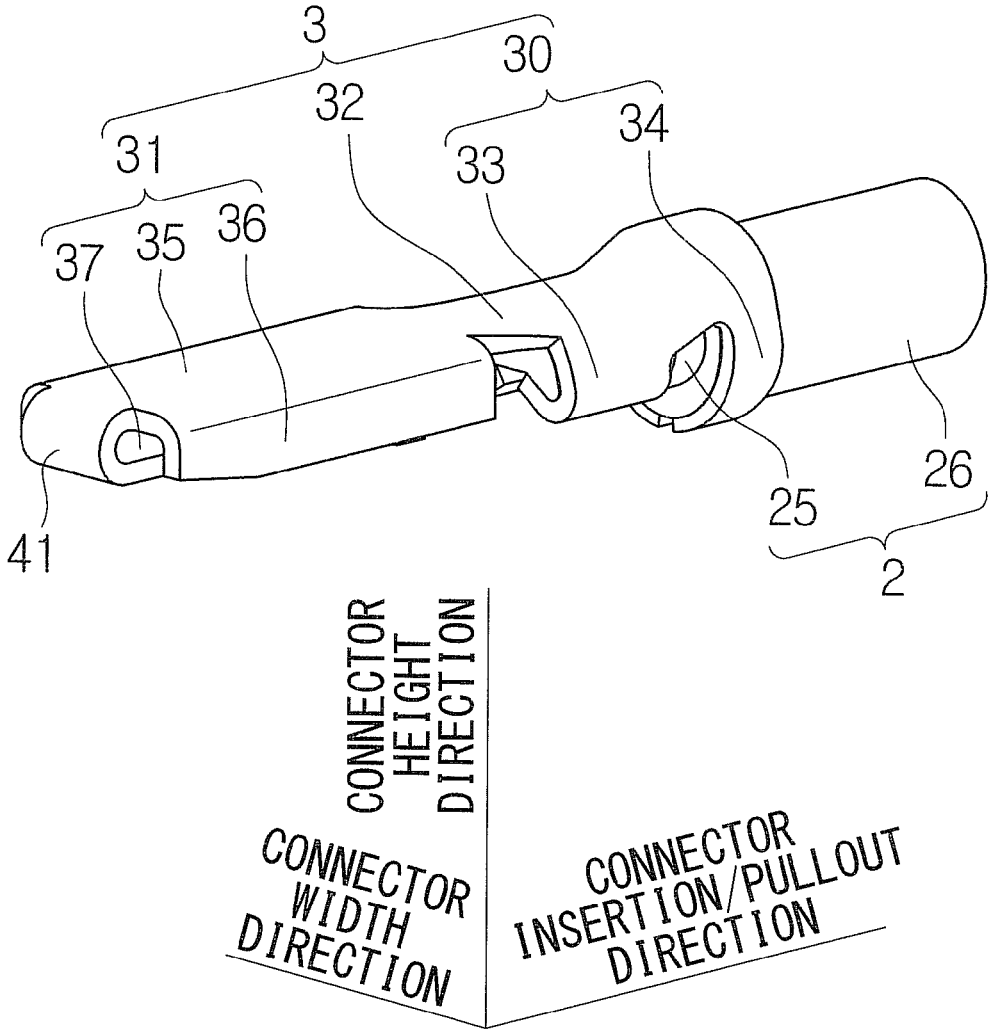
FIG. 11 is a perspective view of a plug (first exemplary embodiment)

(Plug 3: FIGS. 9 to 11)

As shown in FIGS. 9 to 11, the plug 3 is composed of an attachment section 30, an insertion section 31, and a connection section 32.

(Plug 3: Attachment Section 30)

As shown in FIGS. 9 and 10, the attachment section 30 is provided for attaching the electric wire 2 to the plug 3. The attachment section 30 is composed of a conductor crimp section 33 that is crimped onto the stranded wire 25 of the electric wire 2, and a covering crimp section 34 that is crimped onto the insulating covering 26 of the electric wire 2.

(Plug 3: Insertion Section 31)

As shown in FIG. 9, the insertion section 31 is composed of a bottom plate 35, a pair of side plates 36, and a lock spring strip 37. The bottom plate 35 is formed so as to extend in the connector insertion/pullout direction. The pair of side plates 36 connect to the bottom plate 35 in such a manner that the bottom plate 35 is interposed therebetween in the connector width direction. The pair of side plates 36 are formed so as to protrude from the bottom plate 35 toward the mounting surface receding direction. The pair of side plates 36 are opposed to each other. Therefore, the bottom plate 35 and the pair of side plates 36 create roughly a U-shape as viewed in the connector insertion/pullout direction. The lock spring strip 37 is a cantilever-shaped spring strip supported by the bottom plate 35 of the insertion section 31. The lock spring strip 37 connects to the tip of the bottom plate 35 of the insertion section 31 in the insertion direction and is formed so as to extend toward the pull-out direction. Therefore, as shown in FIG. 10, the bottom plate 35 and the lock spring strip 37 of the insertion section 31 are disposed on top of one another as viewed in the connector height direction. Further, the lock spring strip 37 is disposed in a place closer to one of the pair of side plates 36 than to the other side plate 36, and a key insertion gap g is formed between the other side plate 36 and the lock spring strip 37. Further, as shown in FIGS. 9 and 10, a claw section 38 that slightly protrudes in the mounting surface receding direction is formed at the tip of the lock spring strip 37 in the pull-out direction. A tip surface 38*a* of the claw section 38 in the pull-out direction shown in FIG. 10 is perpendicular to the connector insertion/pullout direction in a state where no load is applied on the lock spring strip 37 shown in FIG. 9. Further, as shown in FIG. 9, since the claw section 38 is formed in the lock spring strip 37 in such a manner that the claw section 38 slightly protrudes in the mounting surface receding direction, an inclined guide surface 39 that extends toward the mounting surface approaching direction as it extends towards the insertion direction is formed on the insertion direction side as viewed from the claw section 38.

(Plug 3: Connection Section 32)

As shown in FIGS. 9 to 11, the connection section 32 is provided for connecting the attachment section 30 with the insertion section 31.

(Action)

Next, how to use the wire-to-board connector 1 is explained with reference to FIGS. 12 to 16.

Figure 12:
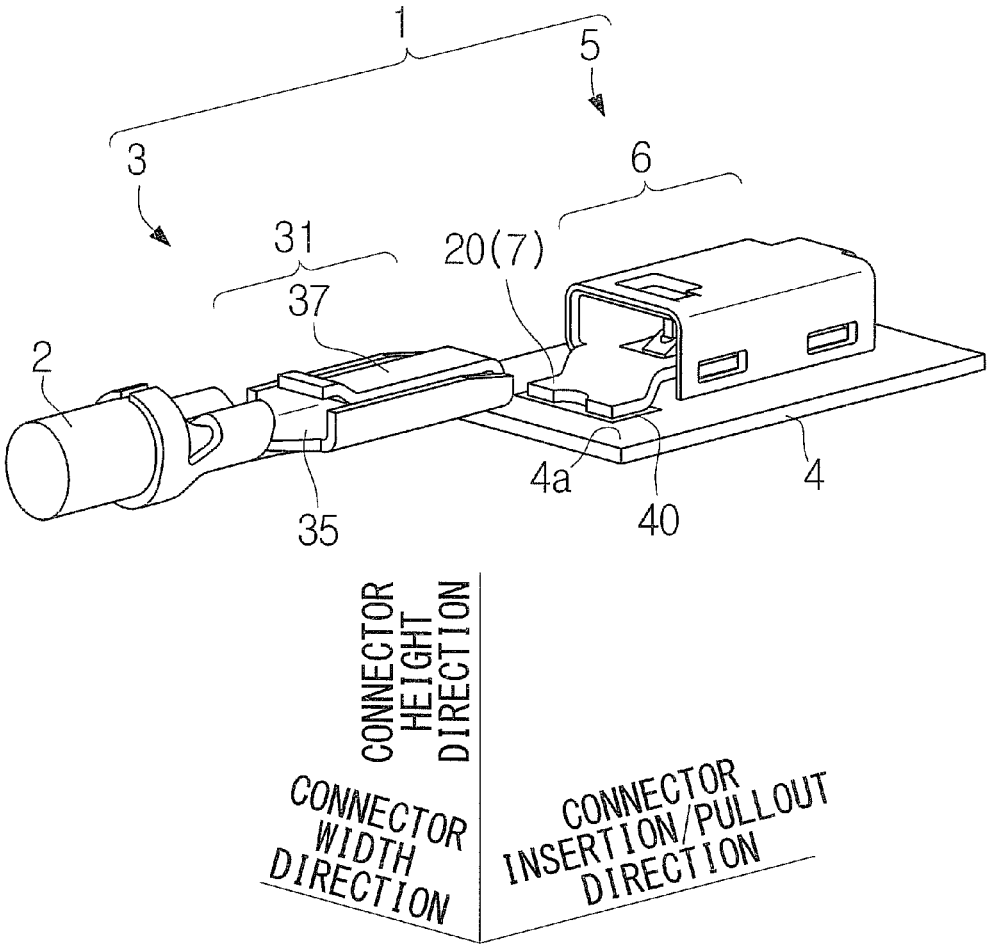
FIG. 12 is a figure for explaining a fitting method of a wire-to-board connector (before plug is inserted into receptacle) (first exemplary embodiment)

Firstly, as shown in FIG. 12, the soldering legs 20 of the mounting section 7 of the receptacle 5 are soldered to respective electrodes pads 40 formed on the connector mounting surface 4*a* of the substrate 4.

Figure 13:
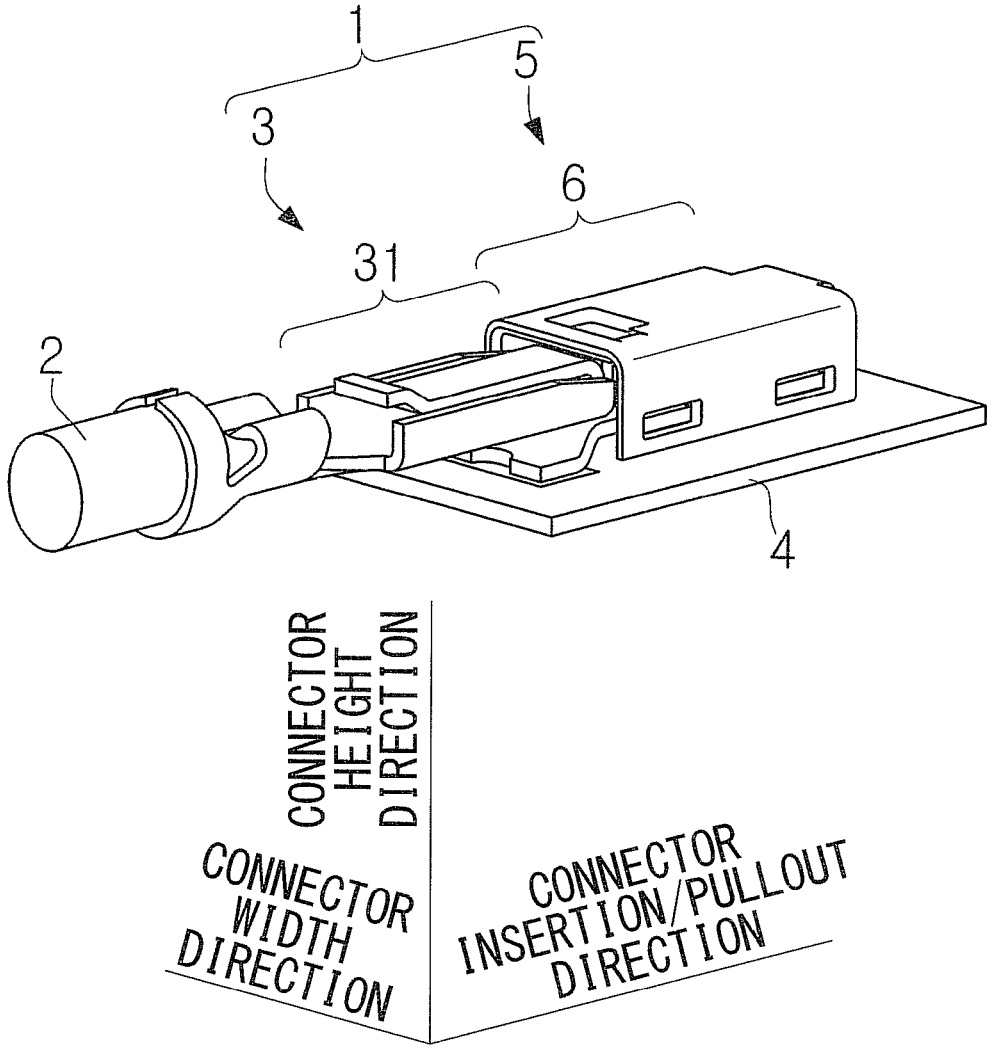
FIG. 13 is a figure for explaining a fitting method of a wire-to-board connector (when plug is inserted into receptacle) (first exemplary embodiment)
Figure 14:
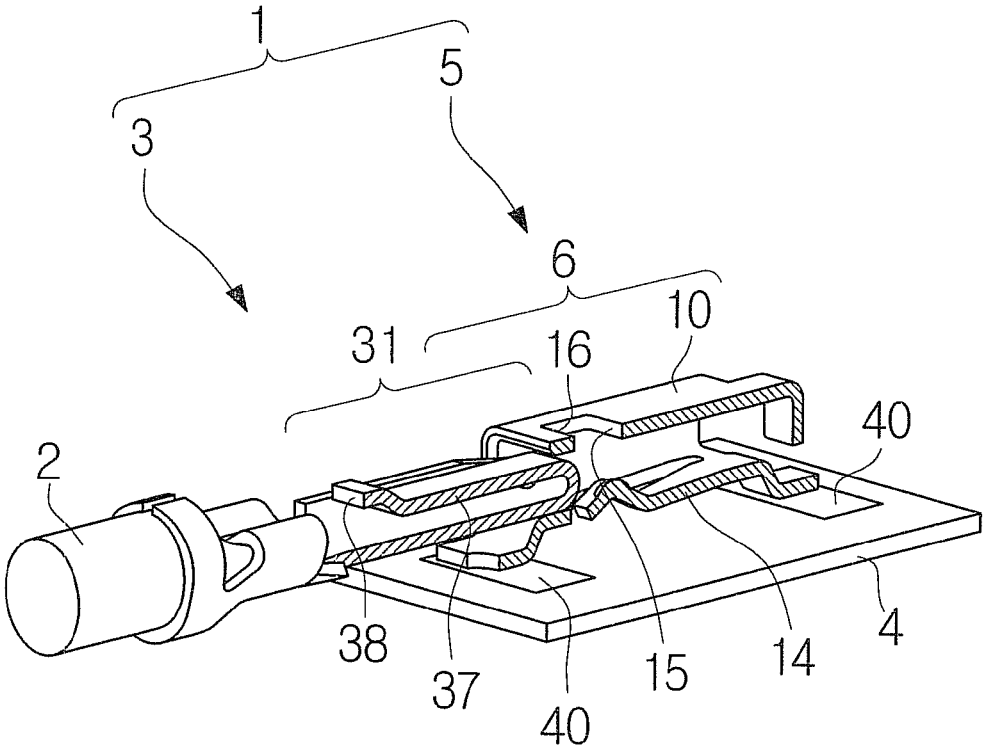
FIG. 14 is a figure for explaining a fitting method of a wire-to-board connector (when plug is inserted into receptacle (cross section)) (first exemplary embodiment)
Figure 14:
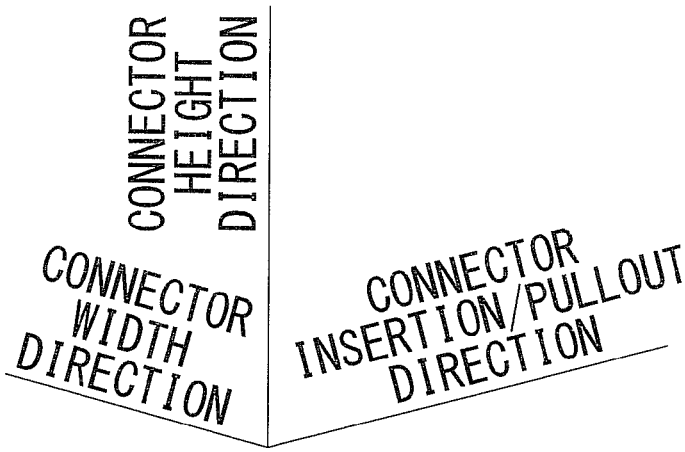
Figure 15:
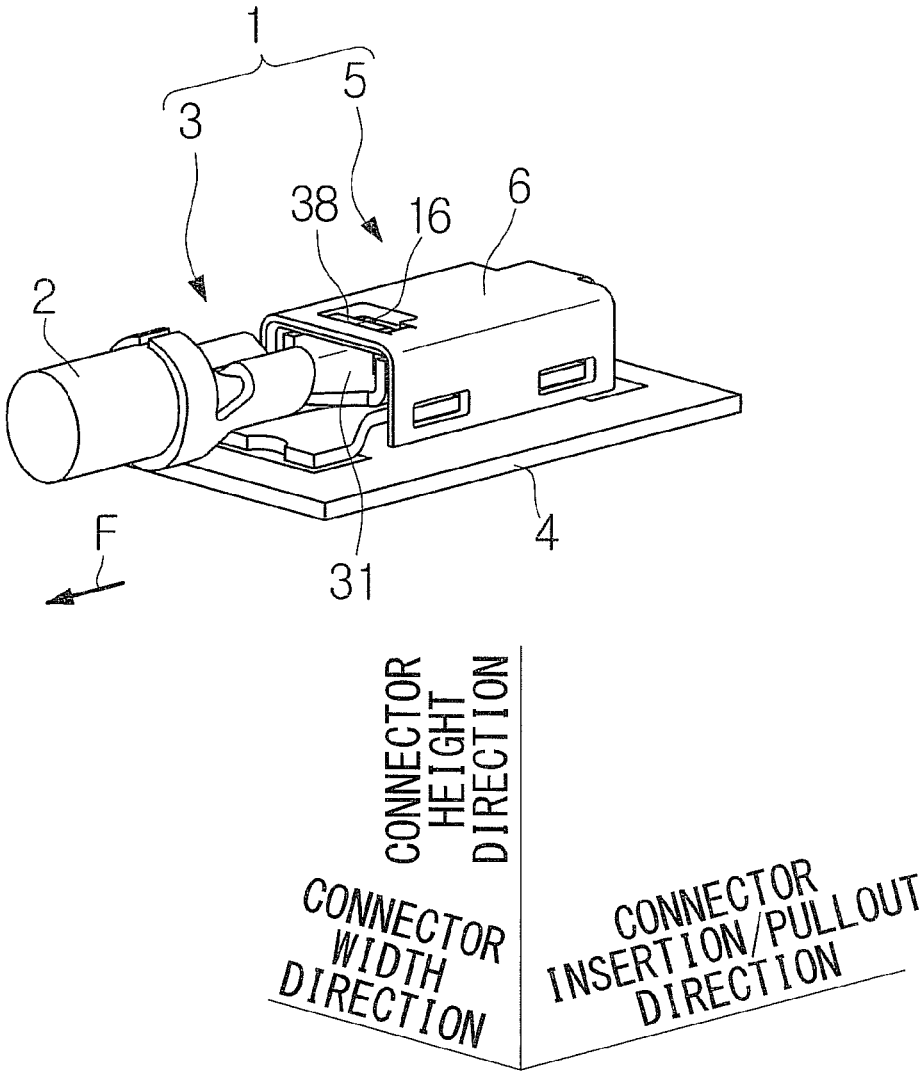
FIG. 15 is a figure for explaining a fitting method of a wire-to-board connector (when plug and receptacle are in fitted state) (first exemplary embodiment)

Next, as shown in FIG. 12, the posture of the plug 3 with respect to the receptacle 5 is adjusted so that the lock spring strip 37 of the insertion section 31 of the plug 3 is positioned on the opposite side to the substrate 4 with the bottom plate 35 of the insertion section 31 of the plug 3 is interposed therebetween. Then, as shown in FIGS. 13 to 15, the insertion section 31 of the plug 3 is inserted into the accommodating section 6 of the receptacle 5. In this process, the insertion section 31 of the plug 3 shown in FIG. 14 presses down the contact spring strip 14 of the accommodating section 6 of the receptacle 5 in the mounting surface approaching direction. Further, in this process, the lock spring strip 37 of the insertion section 31 of the plug 3 is pressed down in the mounting surface approaching direction by the reciprocal action between the inclined guide surface 39 of the lock spring strip 37 of the insertion section 31 of the plug 3 shown in FIG. 9 and the guide chamfering 18 of the top plate 10 of the accommodating section 6 shown in FIG. 7. Then, when the claw section 38 of the lock spring strip 37 of the insertion section 31 of the plug 3 shown in FIG. 14 reaches the lock hole 15 of the top plate 10 of the accommodating section 6 of the receptacle 5, the claw section 38 of the lock spring strip 37 moves into the lock hole 15 due to the self elastic restoring force of the lock spring strip 37. This movement makes the claw section 38 of the plug 3 engage with the engaging surface 16 of the receptacle 5 (see also FIG. 15). Then, as shown in FIG. 15, the plug 3 and the receptacle 5 fit together by this engagement. As a result, the wire-to-board connector 1 provides an electric connection as a connector.

Note that in the fitted state of the plug 3 and the receptacle 5 shown in FIG. 15, even if a pull-out force F is acted on the electric wire 2, the fitted state of the plug 3 and the receptacle 5 is never disengaged. This is because the claw section 38 of the plug 3 and the engaging surface 16 of the accommodating section 6 are configured so as to prevent the pull-out force F acted on the electric wire 2 from acting to disengage the engaged state between the claw section 38 of the plug 3 and the engaging surface 16 of the receptacle 5. Specifically, in the fitted state of the plug 3 and the receptacle 5 shown in FIG. 15, the tip surface 38*a* of the claw section 38 shown in FIG. 10 and the engaging surface 16 shown in FIG. 7 are both perpendicular to the connector insertion/pullout direction.

Further, the electrical conduction between the plug 3 and the receptacle 5 is implemented by all the contact points at which the plug 3 is in contact with the receptacle 5 in FIG. 15. In addition, in this exemplary embodiment, in the fitted state of the plug 3 and the receptacle 5, the contact section 14*b* of the contact spring strip 14 is in strong contact with the bottom plate 35 of the insertion section 31 of the plug 3 shown in FIG. 11 by the self elastic restoring force of the contact spring strip 14 shown in FIG. 7. Therefore, this contact point ensures reliable electrical conduction.

Figure 16:
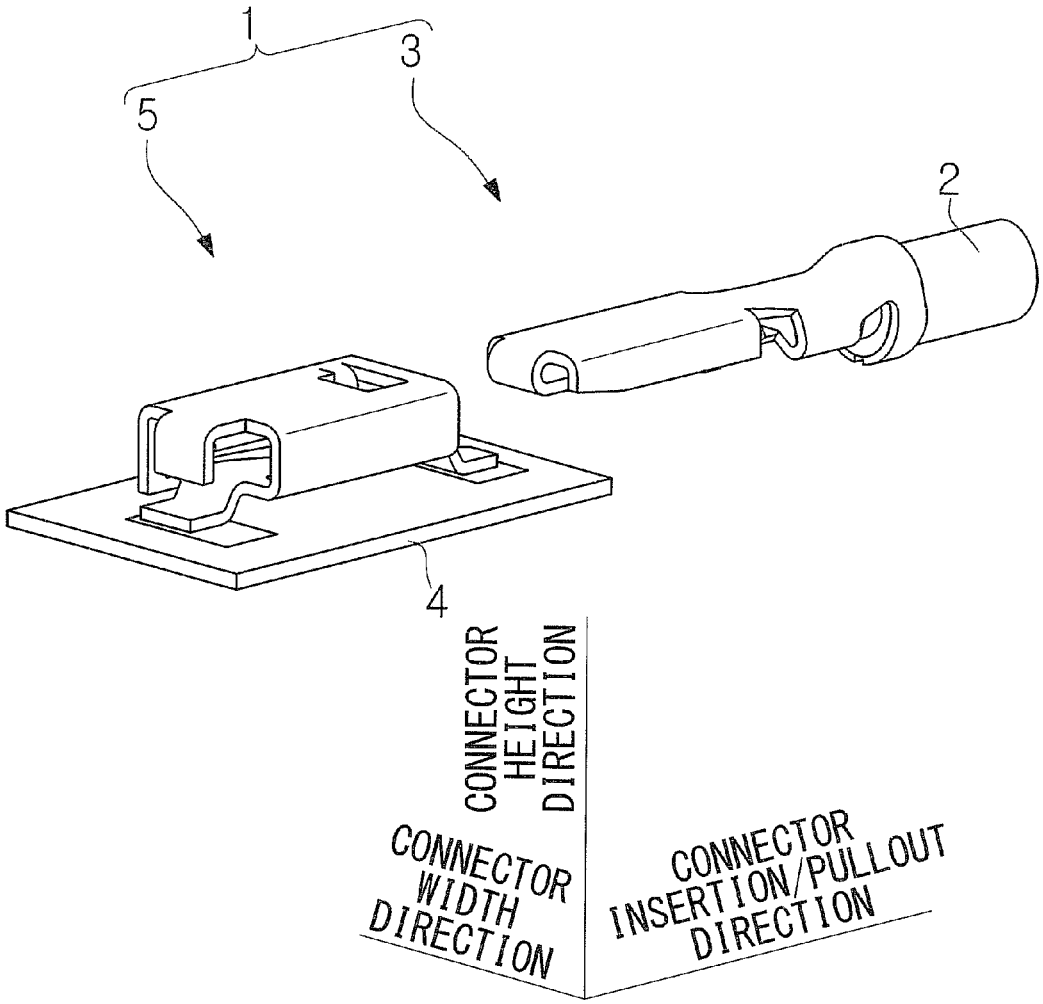
FIG. 16 is a figure for explaining a fitting method of a wire-to-board connector (before plug is inserted into receptacle) (first exemplary embodiment)

Further, as shown in FIGS. 13 and 15, when the insertion section 31 of the plug 3 is inserted into the accommodating section 6 of the receptacle 5, the key 17 of the receptacle 5 shown in FIGS. 5 and 8 is inserted into a key insertion gap g formed between the lock spring strip 37 and the side plate 36 as indicated by a bold arrow G in FIG. 10. Therefore, the presence of the key 17 of the receptacle 5 does not obstruct the insertion of the insertion section 31 of the plug 3 into the accommodating section 6 of the receptacle 5 under a normal circumstance. However, for example, when the insertion section 31 of the plug 3 is attempted to be inserted into the accommodating section 6 of the receptacle 5 while the insertion section 31 is in an upside-down state as shown in FIG. 16, the key 17 of the receptacle 5 shown in FIGS. 5 and 8 physically interferes with the connection section 41 between the bottom plate 35 and the lock spring strip 37 of the insertion section 31 of the plug 3 shown in FIG. 11. Therefore, when the insertion section 31 of the plug 3 is attempted to be inserted into the accommodating section 6 of the receptacle 5 in an improper posture, the presence of the key 17 of the receptacle 5 obstructs the insertion of the insertion section 31 of the plug 3 into the accommodating section 6 of the receptacle 5.

Further, the blocking plate 19 of the receptacle 5 shown in FIG. 5 prevents the insertion section 31 of the plug 3 from being inserted into the accommodating section 6 of the receptacle 5 from a wrong direction. The blocking plate 19 also serves as a stopper that prevents excessive insertion of the insertion section 31.

Note that when the plug 3 needs to be pulled out from the receptacle 5, the claw section 38 shown in FIG. 15 is pressed down by using a jig having a sharp tip. By doing so, the engaged state between the claw section 38 of the plug 3 and the engaging surface 16 of the receptacle 5 is temporarily disengaged.

A preferable first exemplary embodiment according to the present invention has been explained above. To sum up, the first exemplary embodiment has following characteristics.

That is, as shown in FIGS. 1 to 15, the wire-to-board connector 1 includes the plug 3 (first terminal) attached to the electric wire 2 and the receptacle 5 (second terminal) mounted on the substrate 4. Each of the plug 3 and the receptacle 5 is formed by bending a metal plate. The electric wire 2 is electrically connected to the substrate 4 by fitting the plug 3 with the receptacle 5. The receptacle 5 includes the accommodating section 6 formed into a tubular shape. The plug 3 includes the insertion section 31 to be inserted into the accommodating section 6. The insertion section 31 is provided with the claw section 38 and the accommodating section 6 is provided with the engaging surface 16 (engaging section). The claw section 38 is engaged with the engaging surface 16 and the plug 3 is thereby fitted with the receptacle 5 by inserting the insertion section 31 into the accommodating section 6. The claw section 38 and the engaging surface 16 are configured so as to prevent a pull-out force F acted on the electric wire 2 from acting to disengage the engaged state between the claw section 38 and the engaging surface 16. With the structure described above, it is possible to maintain the fitted state of the wire-to-board connector 1 even when a pull-out force F is acted on the electric wire 2.

Note that in the first exemplary embodiment, the claw section 38 is disposed in the insertion section 31 and the engaging surface 16 (engaging section) is disposed in the accommodating section 6. However, instead of using this structure, the engaging section may be disposed in the insertion section 31 and the claw section may be disposed in the accommodating section 6.

Further, the insertion section 31 includes a cantilever-shaped lock spring strip 37. The claw section 38 is formed in the lock spring strip 37. With the structure described above, it is possible to secure a large movable area in which the claw section 38 can be displaced.

Further, the lock hole 15 is formed in the top plate 10 (peripheral wall) of the accommodating section 6. The engaging surface 16 is formed on the inner peripheral surface 15*a* of the lock hole 15. With the structure described above, it is possible to implement the engaging surface 16 with a simple structure.

Further, the key 17 (improper insertion prevention protrusion) that, when the posture of the insertion section 31 is not appropriate as the insertion section 31 is inserted into the accommodating section 6, physically interferes the insertion section 31 and thereby prevents the insertion section 31 from being inserted into the accommodating section 6 is preferably formed in the accommodating section 6. With the structure described above, it is possible, when the posture of the insertion section 31 is not appropriate as the insertion section 31 is inserted into the accommodating section 6, to prevent the insertion section 31 from being inserted into the accommodating section 6.

Further, the key 17 is formed by lancing when the lock hole 15 is formed. With the structure described above, it is possible to form the key 17 at a low cost.

Further, the accommodating section 6 includes the cantilever-shaped contact spring strip 14. The contact spring strip 14 comes into contact with the insertion section 31, which is inserted into the accommodating section 6, by the self elastic restoring force. With the structure described above, it is possible to ensure reliable contact between the plug 3 and the receptacle 5.

Further, in the joint 11 of the accommodating section 6, which is formed into a tubular shape by bending a metal plate, the shape retaining mechanism E for retaining the tubular shape of the accommodating section 6 is formed. With the structure described above, it is possible to retain the tubular shape of the accommodating section 6.

Further, the shape retaining mechanism E is implemented by the shape retaining protrusion 12 and the shape retaining protrusion accommodating hole 13 in which the shape retaining protrusion 12 is accommodated. With the structure described above, the shape retaining mechanism E is implemented with a simple structure, even when the insertion section 31 is forcefully inserted into the accommodating section 6 so that the accommodating section 6 is deformed.

Although a preferable first exemplary embodiment according to the present invention has been explained above, the first exemplary embodiment can be modified as described below.

That is, as shown in FIG. 9, although the electric wire 2 is connected to the plug 3 by crimping by using the conductor crimp section 33 and the covering crimp section 34 in the above-described first exemplary embodiment, the electric wire 2 may be connected to the plug 3 by using other techniques such as soldering instead of using the crimping.

Second Exemplary Embodiment

Next, a second exemplary embodiment according to the present invention is explained with reference to FIGS. 17 and 18. In this exemplary embodiment, the differences of this exemplary embodiment from the above-described first exemplary embodiment are mainly explained and duplicated explanations are omitted as appropriate. Further, components corresponding to respective components of the above-described first exemplary embodiment are basically denoted by the same symbols.

Figure 17:
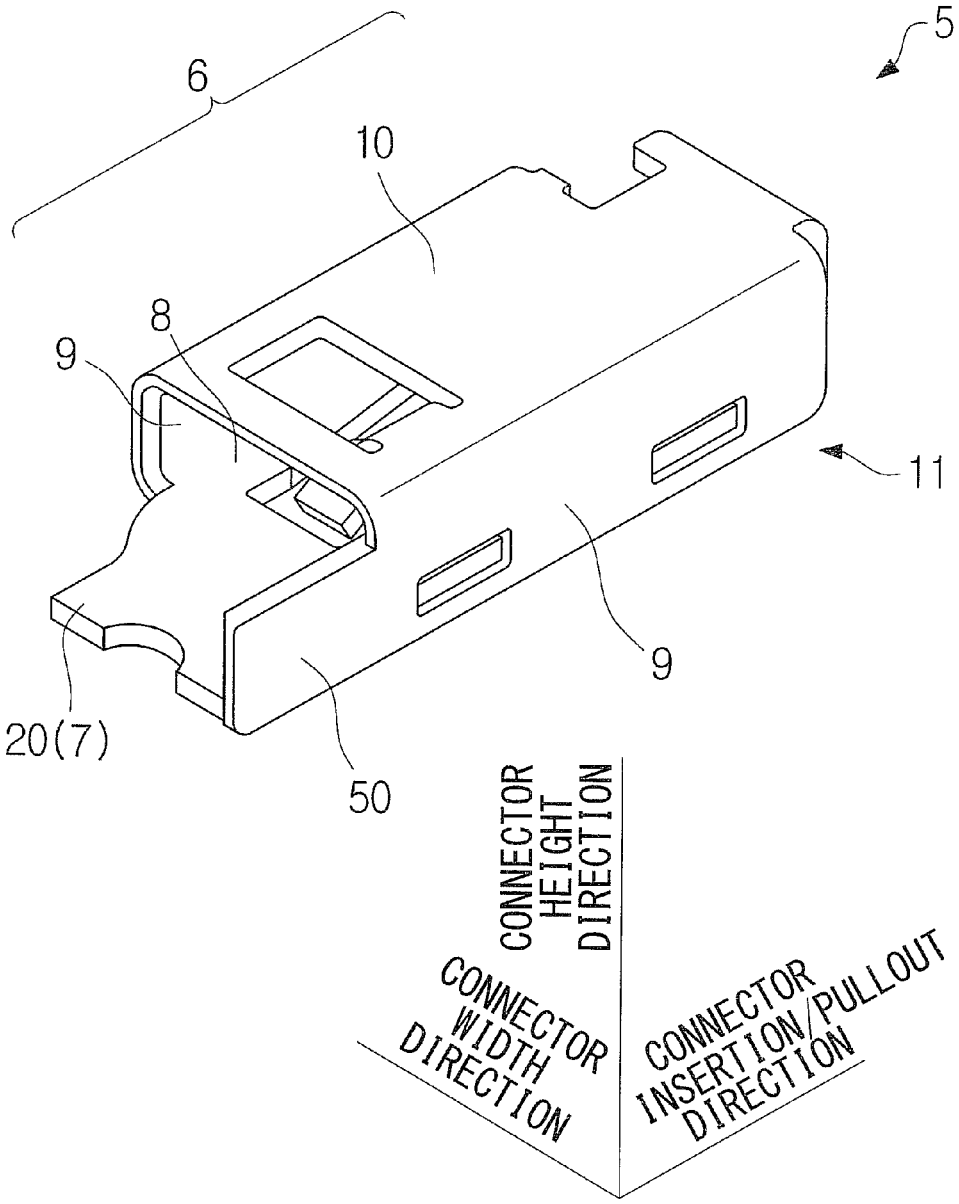
FIG. 17 is a first perspective view of a receptacle (second exemplary embodiment)
Figure 18:
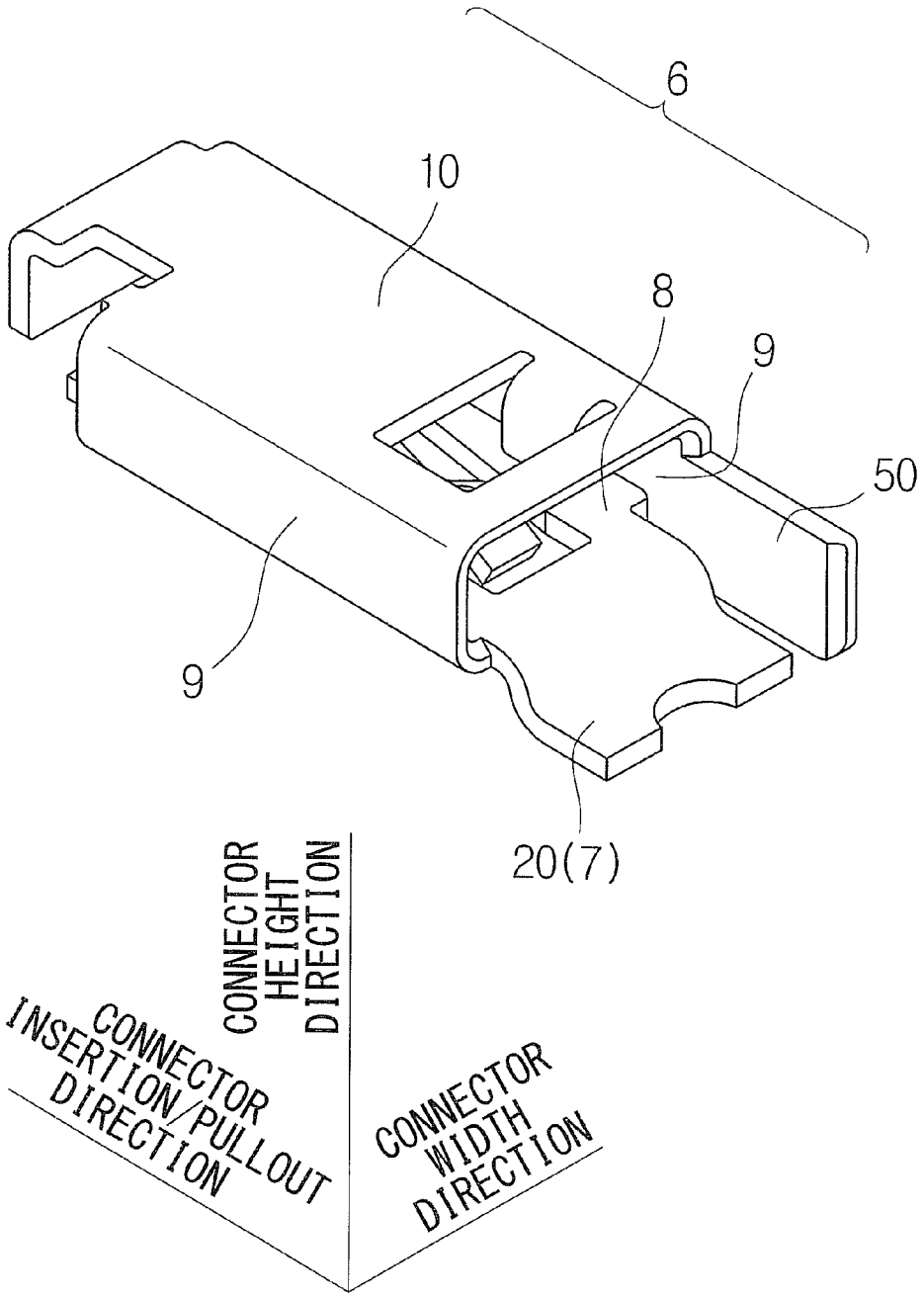
FIG. 18 is a second perspective view of a receptacle (second exemplary embodiment)
Figure 19:
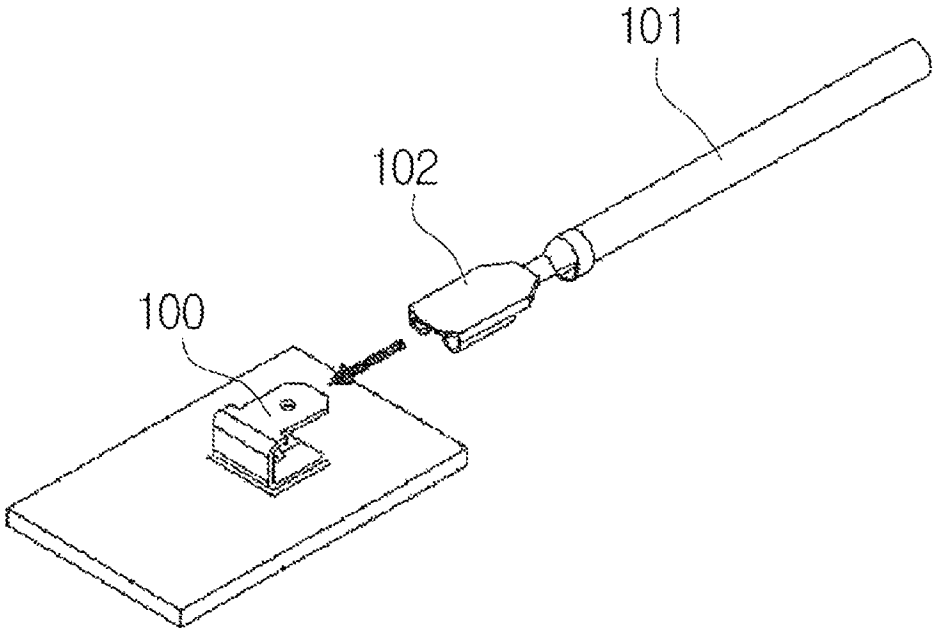
Prior Art Fig. 19
FIG. 19 is a figure corresponding to FIG. 1 of patent literature 1.

In this exemplary embodiment, as shown in FIGS. 17 and 18, the side plate 9 adjacent to the joint 11 extends toward the pull-out direction. As a result, an insertion guide strip 50 (guide strip) is formed. That is, an insertion guide strip 50 is formed in one of the pair of the side plates 9 of the accommodating section 6 of the receptacle 5. In short, the receptacle 5 includes an insertion guide strip 50. This insertion guide strip 50 is a guide strip that guides the insertion of the insertion section 31 into the accommodating section 6. The presence of this insertion guide strip 50 makes the task of inserting the insertion section 31 of the plug 3 into the accommodating section 6 of the receptacle 5 easier even further in comparison to the above-described first exemplary embodiment. That is, it makes the task of fitting the plug 3 with the receptacle 5 easier.

This application is based upon and claims the benefit of priority from Japanese patent application No. 2011-063640, filed on Mar. 23, 2011, the disclosure of which is incorporated herein in its entirety by reference.

REFERENCE SIGNS LIST

1 WIRE-TO-BOARD CONNECTOR
2 ELECTRIC WIRE
3 PLUG (FIRST TERMINAL)
4 SUBSTRATE
4*a* CONNECTOR MOUNTING SURFACE
5 RECEPTACLE (SECOND TERMINAL)
6 ACCOMMODATING SECTION
7 MOUNTING SECTION
8 BOTTOM PLATE
9 SIDE PLATE
10 TOP PLATE (PERIPHERAL WALL)
11 JOINT
12 SHAPE RETAINING PROTRUSION
13 SHAPE RETAINING PROTRUSION ACCOMMODATING HOLE
14 CONTACT SPRING STRIP
14*a* SUPPORT SPRING STRIP
14*b* CONTACT SECTION
15 LOCK HOLE
15*a* INNER PERIPHERAL SURFACE
16 ENGAGING SURFACE (ENGAGING SECTION)
17 KEY (IMPROPER INSERTION PREVENTION PROTRUSION)
18 GUIDE CHAMFERING
19 BLOCKING PLATE
20 SOLDERING LEG
25 STRANDED WIRE
26 INSULATING COVERING
30 ATTACHMENT SECTION
31 INSERTION SECTION
32 CONNECTION SECTION
33 CONDUCTOR CRIMP SECTION
34 COVERING CRIMP SECTION
35 BOTTOM PLATE
36 SIDE PLATE
37 LOCK SPRING STRIP
38 CLAW SECTION
38*a* TIP SURFACE
39 INCLINED GUIDE SURFACE
40 ELECTRODE PAD
41 CONNECTION SECTION
50 INSERTION GUIDE STRIP (GUIDE STRIP)
P INTERNAL SPACE
C CENTER LINE
E SHAPE RETAINING MECHANISM
F PULL-OUT FORCE
g KEY INSERTION GAP
G BOLD ARROW

The invention claimed is:

1. A wire-to-board connector comprising: a first terminal attached to an electric wire; and a second terminal mounted on a substrate, wherein the first and second terminals are formed of metal, and the electric wire is electrically connected to the substrate by fitting the first terminal with the second terminal, and wherein the second terminal comprises an accommodating section formed into a tubular shape by bending a metal plate and a mounting section including a leg, the leg connecting to the accommodating section and being soldered on the substrate, the first terminal comprises an insertion section to be inserted into the accommodating section, the insertion section is provided with a claw section and the accommodating section is provided with an engaging section, through an insertion of the insertion section into the accommodating section, the claw section is engaged with the engaging section and the first terminal is thereby fitted with the second terminal in a joint of the accommodating section, which is formed into the tubular shape by bending the metal plate, a shape retaining mechanism for retaining the tubular shape of the accommodating section is formed, and the shape retaining mechanism is implemented by a shape retaining protrusion and a shape retaining protrusion accommodating hole in which the shape retaining protrusion is accommodated.

2. The wire-to-board connector according to claim 1, wherein the insertion section comprises a cantilever-shaped lock spring strip, and the claw section is formed in the lock spring strip.

3. The wire-to-board connector according to claim 2, wherein the insertion section comprises a pair of mutually-opposed side plates.

4. The wire-to-board connector according to claim 3, wherein the lock spring strip is formed between the pair of mutually-opposed side plates.

5. The wire-to-board connector according to claim 4, wherein the cantilever-shaped lock spring strip is formed in a place closer to one of the pair of side plates than to the other side plate, and a key insertion gap is formed between the lock spring strip and the other side plate.

6. The wire-to-board connector according to claim 5, wherein an improper insertion prevention protrusion to be inserted into the key insertion gap is formed in the accommodating section.

7. The wire-to-board connector according to claim 6, wherein the improper insertion prevention protrusion is formed by lancing from a part of a peripheral wall of the accommodating section.

8. The wire-to-board connector according to claim 7, wherein a lock hole is formed in the peripheral wall of the accommodating section, and the engaging section is formed in an inner peripheral surface of the lock hole.

9. The wire-to-board connector according to claim 8, wherein the improper insertion prevention protrusion is formed by lancing when the lock hole is formed.

10. The wire-to-board connector according to claim 1, wherein a lock hole is formed in a peripheral wall of the accommodating section, and the engaging section is formed in an inner peripheral surface of the lock hole.

11. The wire-to-board connector according to claim 1, wherein a blocking plate is formed in an opened end of the accommodating section that is opposite to an opened end into which the insertion section is inserted.

12. The wire-to-board connector according to claim 1, wherein the accommodating section comprises a cantilever-shaped contact spring strip.

13. The wire-to-board connector according to claim 1, wherein the accommodating section is formed into a rectangular-tube shape.

14. The wire-to-board connector according to claim 1, wherein the second terminal comprises a pair of mutually-opposed side plates, and one of the pair of the side plates extends to form a guide strip that guides the insertion of the insertion section into the accommodating section.

15. A wire-to-board connector comprising:

a first terminal attached to an electric wire; and a second terminal mounted on a substrate, wherein the first and second terminals are formed of metal, and the electric wire is electrically connected to the substrate by fitting the first terminal with the second terminal, and wherein the second terminal comprises an accommodating section formed into a tubular shape, the first terminal comprises an insertion section to be inserted into the accommodating section, the insertion section is provided with a claw section and the accommodating section is provided with an engaging section, and through an insertion of the insertion section into the accommodating section, the claw section is engaged with the engaging section and the first terminal is thereby fitted with the second terminal, wherein the insertion section comprises a cantilever-shaped lock spring strip formed between a pair of mutually-opposed side plates, the claw section is formed in the cantilever-shaped lock spring strip, and the cantilever-shaped lock spring strip is formed in a place closer to one of the pair of side plates than to the other side plate, and a key insertion gap is formed between the lock spring strip and the other side plate.

16. A wire-to-board connector comprising:

a first terminal attached to an electric wire; and a second terminal mounted on a substrate, wherein the first and second terminals are formed of metal, and the electric wire is electrically connected to the substrate by fitting the first terminal with the second terminal, and wherein the second terminal comprises an accommodating section formed into a tubular shape, the first terminal comprises an insertion section to be inserted into the accommodating section, the insertion section is provided with a claw section and the accommodating section is provided with an engaging section, and through an insertion of the insertion section into the accommodating section, the claw section is engaged with the engaging section and the first terminal is thereby fitted with the second terminal, wherein the insertion section comprises a cantilever-shaped lock spring strip formed between a pair of mutually-opposed side plates, and the cantilever-shaped lock spring strip is formed in a place closer to one of the pair of side plates than to the other side plate, and a key insertion gap is formed between the lock spring strip and the other side plate.

* * * * *